US009113702B2

(12) United States Patent
Koolhaas et al.

(10) Patent No.: US 9,113,702 B2
(45) Date of Patent: Aug. 25, 2015

(54) ARTICLE OF FURNITURE

(71) Applicants: Rem Koolhaas, Rotterdam (NL); Andrew Blair Hector, Red Hill, PA (US)

(72) Inventors: Rem Koolhaas, Rotterdam (NL); Andrew Blair Hector, Red Hill, PA (US)

(73) Assignee: Office for Metropolitan Architecture (O.M.A.) Stedebouw B.V., Rotterdam (NL)

( * ) Notice: Subject to any disclaimer, the term of this patent is extended or adjusted under 35 U.S.C. 154(b) by 0 days.

(21) Appl. No.: 14/253,133

(22) Filed: Apr. 15, 2014

(65) Prior Publication Data

US 2014/0311389 A1 Oct. 23, 2014

Related U.S. Application Data

(60) Provisional application No. 61/814,919, filed on Apr. 23, 2013.

(51) Int. Cl.

| | |
|---|---|
| ***A47B 46/00*** | (2006.01) |
| ***A47B 13/08*** | (2006.01) |
| ***A47B 96/18*** | (2006.01) |
| ***A47B 49/00*** | (2006.01) |
| ***A47B 67/00*** | (2006.01) |

(52) U.S. Cl.

CPC ..... *A47B 13/081* (2013.01); *A47B 46/00* (2013.01); *A47B 49/004* (2013.01); *A47B 67/00* (2013.01); *A47B 96/18* (2013.01)

(58) Field of Classification Search

CPC ..... A47B 11/00; A47B 13/081; A47B 96/18
USPC ..... 312/140.1–140.4, 308, 309, 322, 326; 108/91, 92, 93, 94, 102, 103, 139, 140
See application file for complete search history.

(56) References Cited

U.S. PATENT DOCUMENTS

| | | | | |
|---|---|---|---|---|
| 938,242 | A * | 10/1909 | Johnston | 108/94 |
| 2,293,496 | A * | 8/1942 | Egger | 108/93 |
| 4,180,298 | A | 12/1979 | Borgerson, Jr. | |

(Continued)

FOREIGN PATENT DOCUMENTS

| | | |
|---|---|---|
| DE | 29604563 U1 | 6/1996 |
| GB | 977734 | 12/1964 |

OTHER PUBLICATIONS

The International Search Report for PCT/US2014/034507 dated Jul. 10, 2014.

(Continued)

*Primary Examiner* — Daniel Rohrhoff
(74) *Attorney, Agent, or Firm* — Buchanan Ingersoll & Rooney PC

(57) ABSTRACT

An article of furniture includes a base support, an intermediate support moveably attached to the base support via a first moveable attachment mechanism, and a top support moveably attached to the intermediate support via a second moveable attachment mechanism. The first moveable attachment mechanism includes a first rotatable member that rotates about a first axis of rotation such that the intermediate support is rotatable relative to the base support and is rotatable relative to the top support. The second moveable attachment mechanism includes a second rotatable member that is rotatable about a second axis of rotation such that the top support is rotatable relative to the intermediate support and is also rotatable relative to the base support.

20 Claims, 10 Drawing Sheets

(56) References Cited

U.S. PATENT DOCUMENTS

| | | | | |
|---|---|---|---|---|
| 5,138,955 | A | 8/1992 | Manner | |
| 5,157,891 | A | 10/1992 | Nelson | |
| 6,705,655 | B2 * | 3/2004 | Yang | 294/161 |
| 8,277,070 | B1 | 10/2012 | Schwarz | |
| 2004/0065234 | A1 * | 4/2004 | Bullock et al. | 108/22 |
| 2007/0241509 | A1 * | 10/2007 | Kolbaba | 273/309 |
| 2008/0295449 | A1 | 12/2008 | Fisher | |
| 2010/0101461 | A1 * | 4/2010 | Brault et al. | 108/140 |
| 2011/0031140 | A1 | 2/2011 | Clishem | |
| 2011/0219988 | A1 * | 9/2011 | Stephens | 108/6 |
| 2012/0042808 | A1 * | 2/2012 | Allen et al. | 108/25 |
| 2014/0311062 | A1 * | 10/2014 | Koolhaas et al. | 52/183 |

OTHER PUBLICATIONS

Written Opinion of the International Searching Authority for PCT/US2014/034507 dated Jul. 10, 2014.

* cited by examiner

ARTICLE OF FURNITURE

CROSS-REFERENCE TO RELATED APPLICATIONS

The present application claims priority to U.S. Provisional Patent Application No. 61/814,919, which was filed on Apr. 23, 2013.

FIELD OF INVENTION

The present invention relates to furniture, and more particularly, to counters and other articles of furniture. An example of a counter may be a piece of furniture that has a horizontal work surface or upper surface, which may be referred to as a countertop that is supported by a base. Some counters may also have multiple drawers in which items may be stored below the countertop, shelves on which items may be stored above or below the countertop, or both drawers and shelves.

BACKGROUND OF THE INVENTION

Articles of furniture such as counters often have an upper surface on which a person may work or place things. Examples of counters may be appreciated from U.S. Pat. Nos. 8,277,070, 5,157,891, 5,138,955, 4,180,298 and U.S. Pat. App. Pub. No. 2008/0295449.

Counters often have a fixed position or are configured to be utilized in only one configuration. Such a design fails to permit a counter to be used in different ways to accommodate different desired uses for the counter. Such designs also fail to permit counters to be adjusted to provide different aesthetic effects.

We have determined that a new counter design is needed that permits a counter to be adjustable so that a user may utilize the counter in different ways or reposition the counter to provide different aesthetic effects. In one embodiment, the counter may also have drawers or support shelves to store items such as clothes, footwear, dishes, papers, office supplies, or other materials.

SUMMARY OF THE INVENTION

An article of furniture may include a base support, an intermediate support moveably attached to the base support via a first moveable attachment mechanism and a top support moveably attached to the intermediate support via a second moveable attachment mechanism. The first moveable attachment mechanism may include a first rotatable member that rotates about a first axis of rotation such that the intermediate support is rotatable relative to the base support and is rotatable relative to the top support. The second moveable attachment mechanism may include a second rotatable member that is rotatable about a second axis of rotation such that the top support is rotatable relative to the intermediate support and is also rotatable relative to the base support.

The article of furniture may be a counter in some embodiments. The counter may be configured to include drawers or shelves. For instance, at least one drawer may be supported by each of the top support, base support and intermediate support.

In some embodiments of the article of furniture, the second moveable attachment mechanism may also include a slideability mechanism by which the top support is horizontally moveable relative to the intermediate support and the base support. For instance, the top support may be moveable axially in a direction along which the length of the top support extends. The slideability mechanism may be attached between the second rotatable member and the top support. For instance, the slideability mechanism may include a plate attached to a top portion of the second rotatable member and a plurality of guides attached to the plate. Each of the guides may have a channel. A plurality of rails may be included in the slideability mechanism and each of the rails slideable within the channel of at least one of the guides. The rails may be attached to a frame of the top support.

Some embodiments of the first moveable attachment mechanism may also include a slideability mechanism. For such embodiments, the slideability mechanism of the second moveable attachment mechanism may be considered a first slideability mechanism and the slideability mechanism of the first moveable attachment mechanism may be referred to as a second slideability mechanism. The second slideability mechanism may be configured so that the intermediate support is horizontally moveable relative to the base support and the top support. For instance, the intermediate support may be moveable axially in a direction along which the length of the intermediate support extends. The second slideability mechanism may be comprised of a second plate attached to a top portion of the first rotatable member, a plurality of second guides attached to the second plate, and a plurality of second rails. Each of the second guides may have a second channel and each of the second rails may be slideable within the second channel of at least one of the second guides. The second rails may each be attached to a frame of the intermediate support.

Embodiments of the article of furniture may also include a plurality of housings. The housings may include a first housing attached to the top support to encase the top support and a second housing attached to the intermediate support to encase the intermediate support. The housings may also include a third housing attached to the base support to encase the base support. The first housing may be spaced from the second housing and the third housing may be spaced from the second housing. For instance, there may be a first gap defined between the first and second housings and a second gap defined between the third and third and second housings. Each gap may be relatively small, such as between a 0.5 centimeters and a 2.54 centimeter wide gap extending between adjacent housings. A portion of the second rotatable member can extend out of the second housing and into the first housing and a portion of the first rotatable member may extend out of the third housing and into the second housing.

A counter is also provided. The counter may include a base support; an intermediate support moveably attached to the base support via a first moveable attachment mechanism; and a top support moveably attached to the intermediate support via a second moveable attachment mechanism. The first moveable attachment mechanism may include a first rotatable member that rotates about a first axis of rotation such that the intermediate support is rotatable relative to the base support and is rotatable relative to the top support. The second moveable attachment mechanism may include a second rotatable member that has a top portion attached to the top support. The second rotatable member is rotatable about a second axis of rotation such that the top support is rotatable relative to the intermediate support and is also rotatable relative to the base support. The second moveable attachment mechanism could also include a first slideability mechanism attached to a top portion of the second rotatable member to attach the second rotatable member to the top support. The first slideability mechanism may moveably attach the top support to the second rotatable member such that the top support is horizontally moveable relative to the intermediate support and the base support.

In some embodiments of the counter, the first slideability mechanism may be comprised of a first plate attached to a top portion of the second rotatable member, and a plurality of first guides attached to the first plate. Each of the first guides may have a first channel. The first slideability mechanism may also include a plurality of first rails. Each of the first rails may be slideable within the channel of at least one of the first guides and each of the first rails may be attached to a frame of the top support.

The first moveable attachment mechanism may also be comprised of a second slideability mechanism by which the intermediate support is horizontally moveable relative to the base support and the top support. The second slideability mechanism may be comprised of a second plate attached to a top portion of the first rotatable member and a plurality of second guides attached to the second plate. Each of the second guides may have a second channel. A plurality of second rails may also be included in the second slideability mechanism. Each of the second rails can be slideable within the second channel of at least one of the second guides and each of the second rails may be attached to a frame of the intermediate support.

Embodiments of the counter or other article of furniture can also include a first linear movement dampening mechanism attached to the first slideability mechanism that comprises a first pulley and a second pulley position adjacent opposite ends of the top support and a chain or cable entrained around the first and second pulleys of the first linear movement dampening mechanism. At least one of the first and second pulleys of the first linear movement dampening mechanism is connected to the top support such that horizontal linear motion of the top support drives rotation of the chain or cable around the first and second pulleys of the first linear movement dampening mechanism. The counter can also include a first rotatable dampening mechanism connected to the first rotatable member and a second rotatable dampening mechanism connected to the second rotatable member. The counter can also include a second linear movement dampening mechanism comprising a first pulley and a second pulley position adjacent opposite ends of the intermediate support and a chain or cable entrained around the first and second pulleys of the second linear movement dampening mechanism. At least one of the first and second pulleys of the second linear movement dampening mechanism can be connected to the intermediate support such that linear horizontal motion of the intermediate support drives rotation of the chain or cable around the first and second pulleys of the second linear movement dampening mechanism. The first rotatable dampening mechanism can comprise at least one damper element connected to the first rotatable member by at least one gear member to regulate a speed at which the first rotatable member is rotatable and the second rotatable dampening mechanism can comprise at least one damper element connected to the second rotatable member by at least one gear member to regulate a speed at which the first rotatable member is rotatable The counter can also include a plurality of housings comprising a first housing and a second housing. The first housing can be attached to the top support to encase the top support and the second housing may be attached to the intermediate support to encase the intermediate support. The housings can also comprise a third housing attached to the base support to encase the base support. The first housing may be spaced apart from the second housing and the third housing may be spaced apart from the second housing. A portion of the second rotatable member may extend out of the second housing and into the first housing and a portion of the first rotatable member may extend out of the third housing and into the second housing.

For some embodiments of the counter, the first housing, second housing, and third housing each has at least one drawer. In other embodiments, only the first housing or both the first and second housings have at least one drawer. The counter may also include one or more shelves. For instance, one or more shelves may be supported in each of the housings, one or more shelves may be on only one of the housings, or at least one shelf may be positioned in only one of the housings.

Other details, objects, and advantages of the invention will become apparent as the following description of certain present preferred embodiments thereof and certain present preferred methods of practicing the same proceeds.

BRIEF DESCRIPTION OF THE DRAWINGS

Present preferred embodiments of the counter are shown in the accompanying drawings. It should be appreciated that like reference numbers used in the drawings may identify like components.

DETAILED DESCRIPTION OF EXEMPLARY EMBODIMENTS

Figure 1:
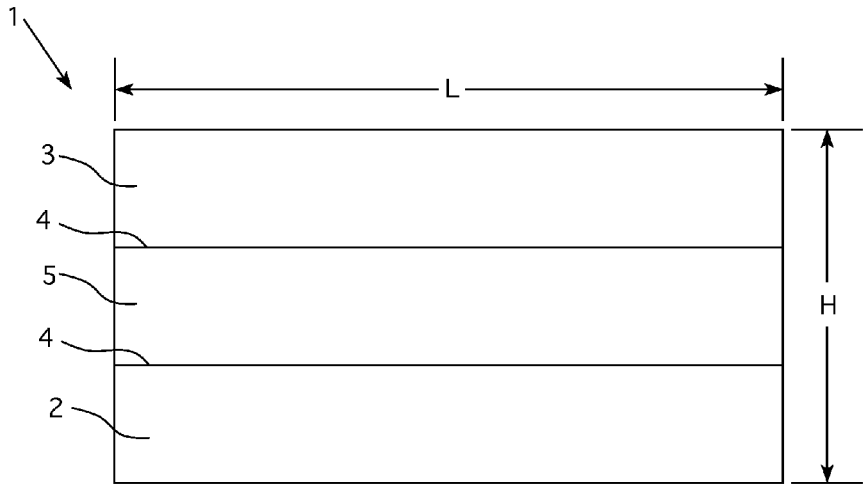
FIG. 1 is a front view of a first exemplary embodiment of a counter in a first orientation.

An article of furniture may be configured as a counter 1. The counter 1 may include a base that supports a countertop. For instance, the counter 1 may include a base member 2 and a top member 3. The top surface of the top member 3 may be a countertop. An intermediate member 5 may be positioned between the base member 2 and the top member 3. The top member 3, intermediate member 5 and base member 2 may each have one or more drawers that are slideable into and out of each element. Alternatively, each member may not have any drawers attached thereto.

Each of the top member 3, base member 2, and intermediate member 5 may be comprised of a structure to support a rectangular shaped element or a polygonal shaped horizontally elongated element of the counter 1. For instance, the top, bottom, and intermediate members 3, 2 and 5 may each be rectangular shaped boxes that are elongated horizontally. The top and intermediate members 3 and 5 may be spaced apart from each other by a relatively small gap 4 (e.g. a gap of between 0.08 cm and 0.32 cm in size, or 1/16 of an inch to 1/8 of an inch in size). The base member 2 may also be spaced apart from the intermediate member 5 by a relatively small gap 4. (e.g. a gap of between 0.08 cm and 0.32 cm in size, or 1/16 of an inch to 1/8 of an inch in size). The intermediate member 5 may be moveably connected to the base member 2 and the top member 3 may be moveably connected to the intermediate member 5 to permit the top and intermediate members 3 and 5 to be moveable relative to each other and relative to the base 2 to permit the counter 1 to be adjusted into different orientation as may be appreciated from FIG. 1-2.

For instance, in a first orientation as shown in FIG. 1, the counter may be configured so that the top surface of the top member functions as a countertop and is the lone upper surface viewable from the top of the counter. The top member 3 in such an orientation may fully cover the top of the intermediate member 5 and the intermediate member 5 may fully cover the top of the base member 2.

Figure 2:
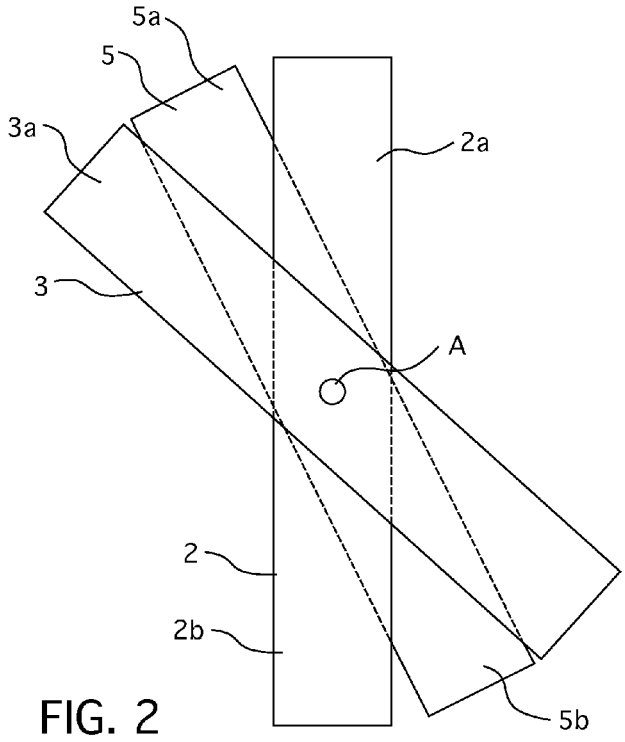
FIG. 2 is a top view of the first exemplary embodiment of the counter in a second orientation.
Figure 3:
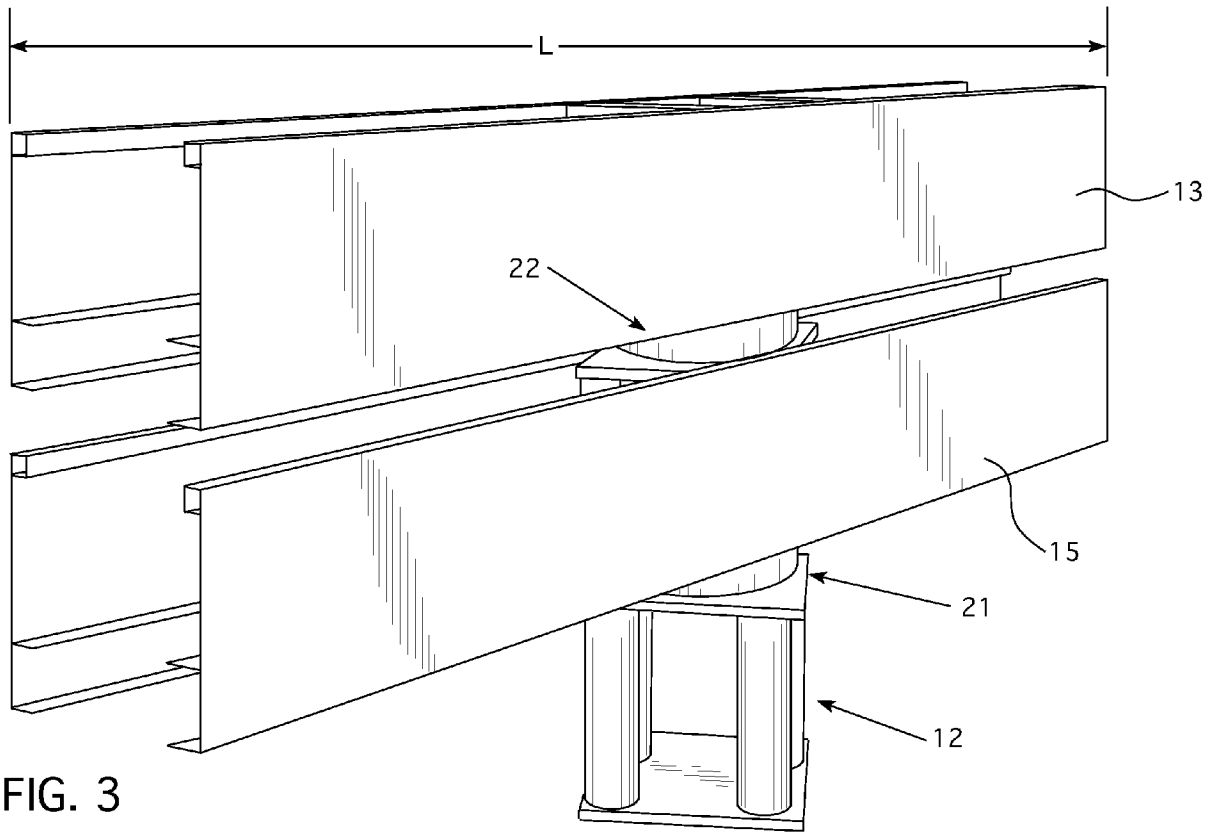
FIG. 3 is a perspective view of the first exemplary embodiment of the counter in which the counter is in the first orientation. Portions of the counter are cut away to illustrate mechanisms by which the top and intermediate members are moveable relative to each other and relative to the base member. It should be understood that the movement mechanisms permit the top and intermediate members to each be moveable independent of each other and independent of the base member.
Figure 4:
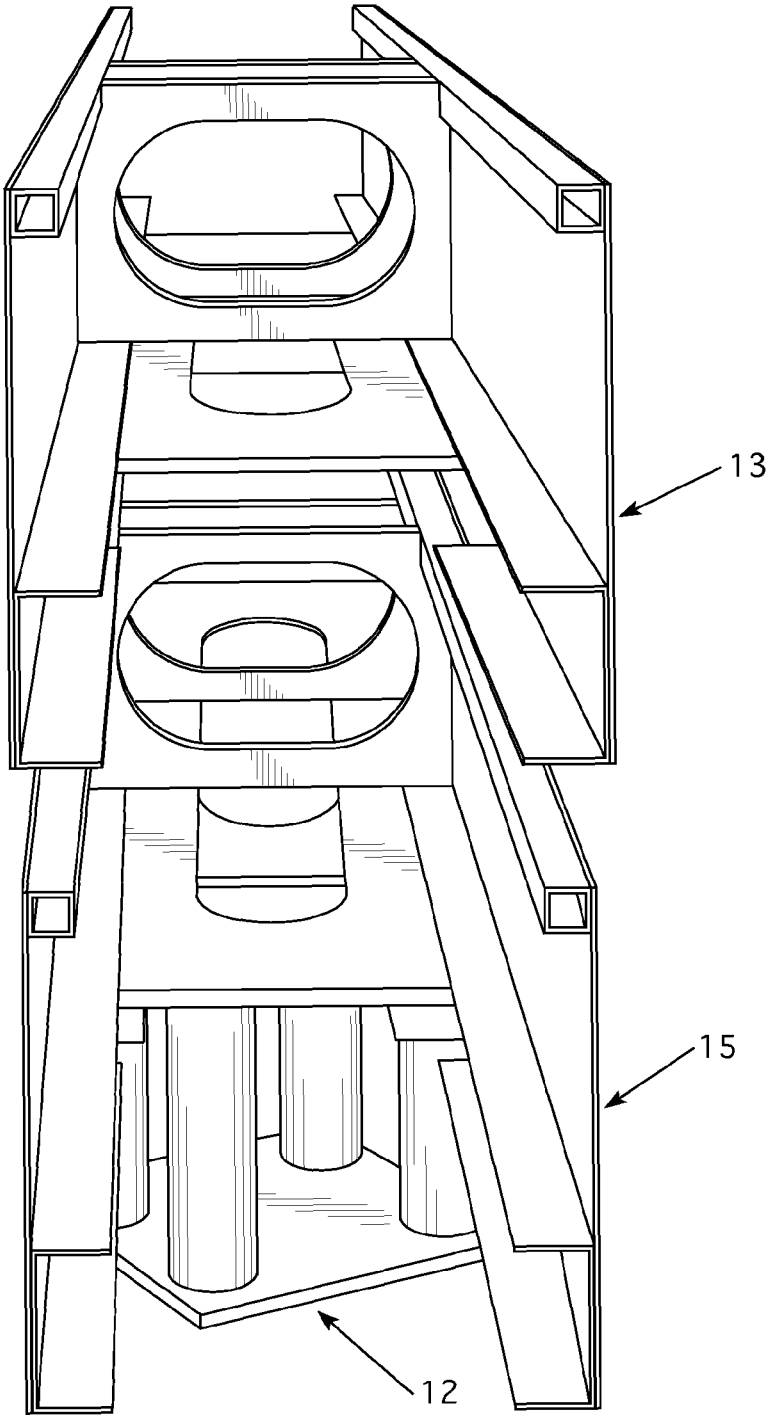
FIG. 4 is a side view of the first exemplary embodiment of the counter in the first orientation. Portions of the counter are cut away to illustrate mechanisms by which the top and intermediate members are moveable relative to each other and relative to the base member.
Figure 5:
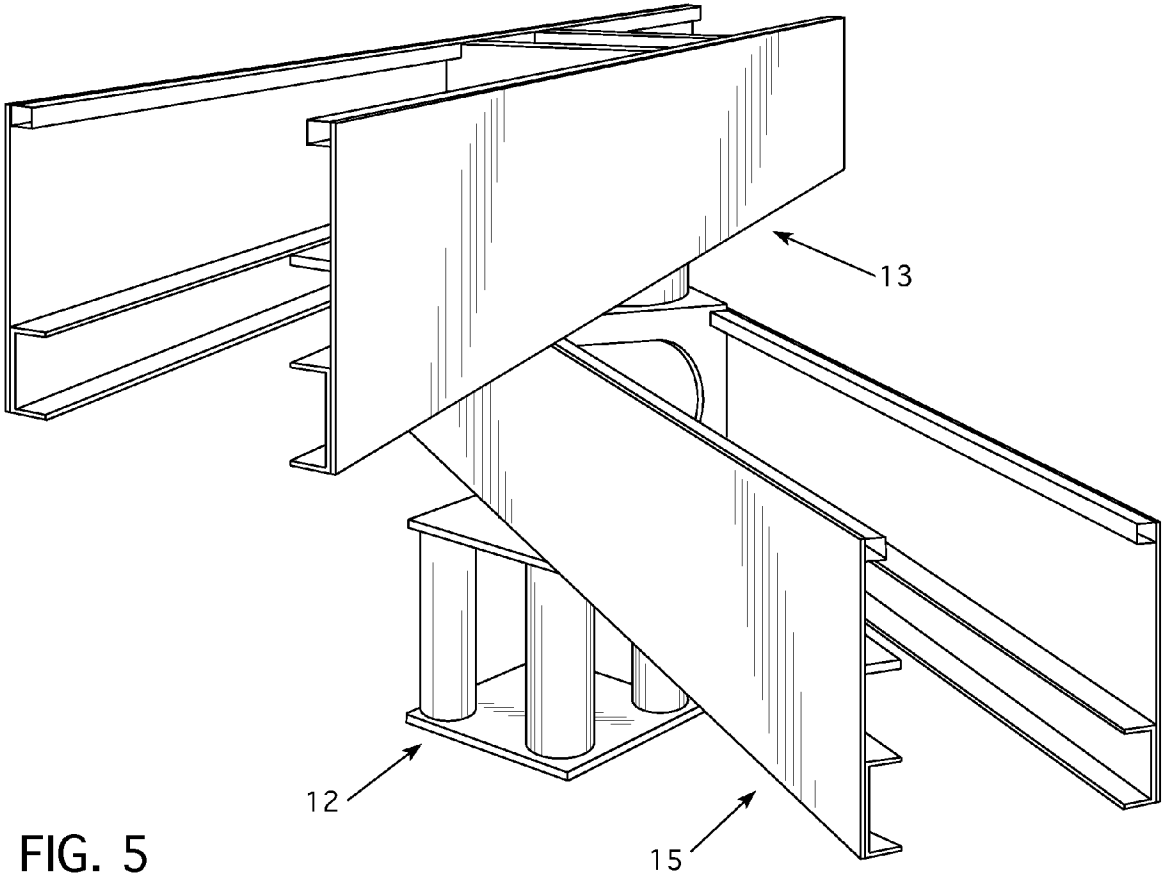
FIG. 5 is a perspective view of the first exemplary embodiment of the counter in the second orientation. Portions of the counter are cut away to illustrate mechanisms by which the top and intermediate members are moveable relative to each other and relative to the base member.
Figure 6:
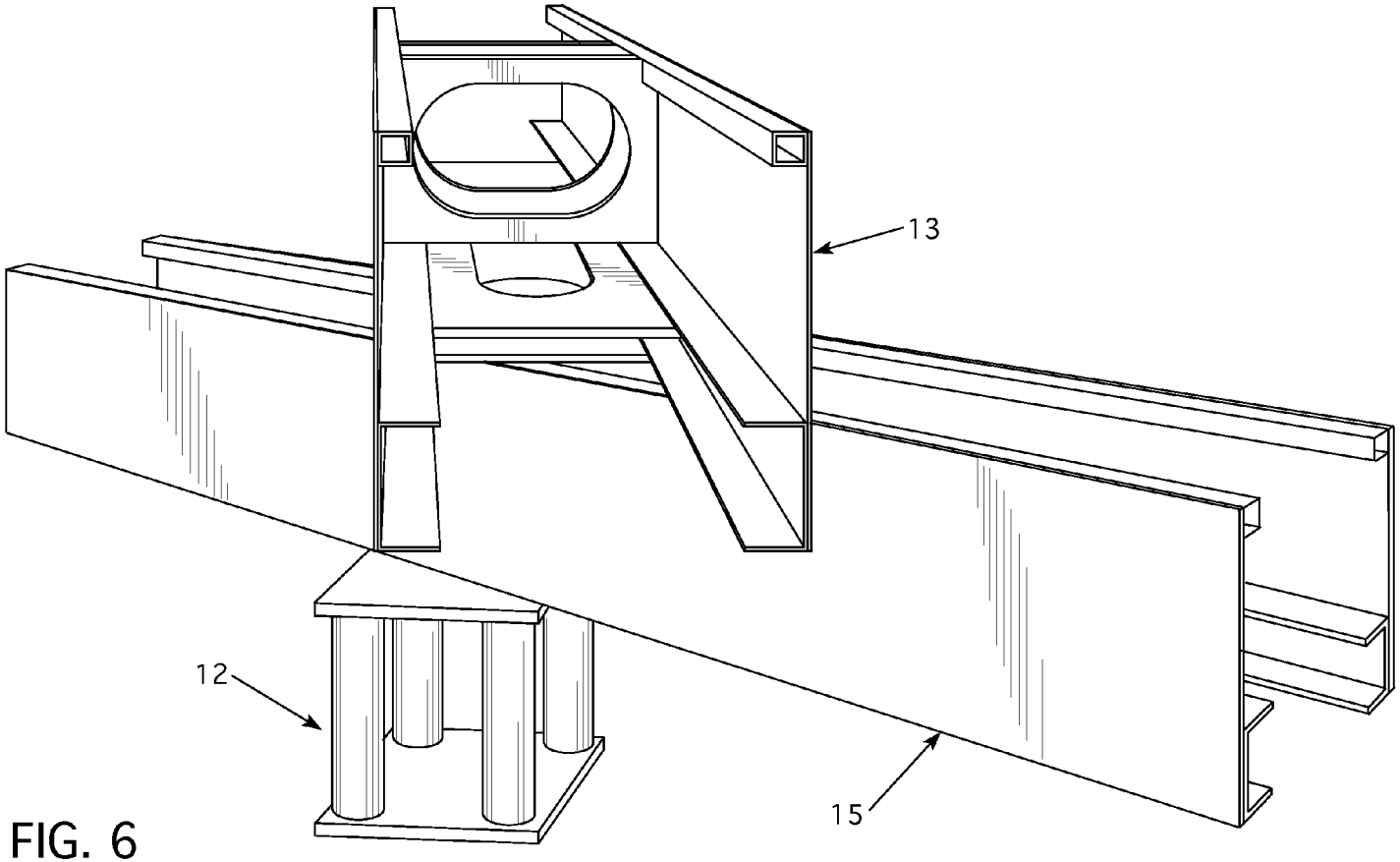
FIG. 6 is another perspective view of the first exemplary embodiment of the counter. Portions of the counter are cut away to illustrate mechanisms by which the top and intermediate members are moveable relative to each other and relative to the base member.
Figure 7:
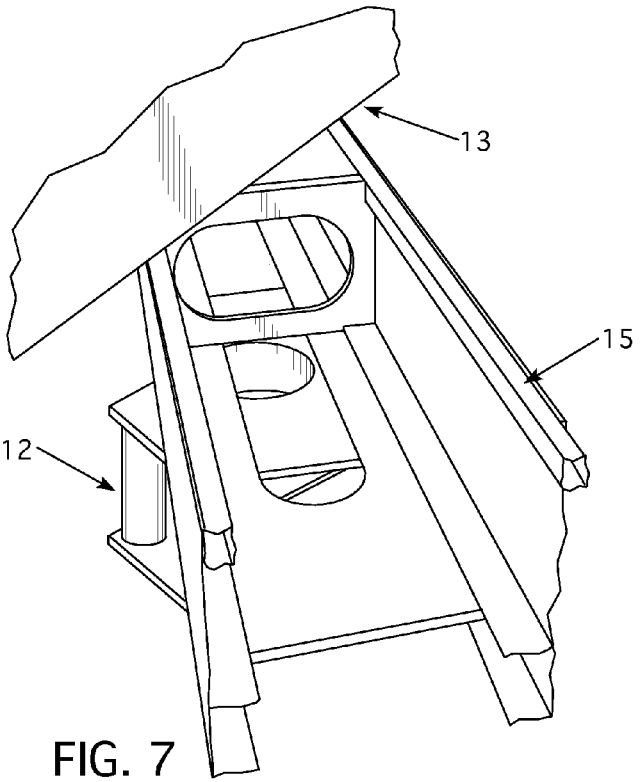
FIG. 7 is an enlarged fragmentary view of the first exemplary embodiment of the counter to illustrate a first moveable mechanism that attaches the intermediate member to the base member.

In the second orientation shown in FIG. 2 and also in other orientations, the intermediate member 5 and top member 3 may be moved so that a portion of the top surface of the base and intermediate members 2 and 5 are visible and are left uncovered by the top member 3. Such a change in orientation can increase the surface area on which a user could place objects on the counter and can also alter the aesthetic effect provided by the counter to a more desired one so that the counter may be arranged to meet different users' preferences in terms of style and functionality.

For instance, in the second orientation, the top member and intermediate member are moved to different locations such that the top surface 3*a* is offset relative to first and second end portions 5*a* and 5*b* of the top surface of the intermediate member 5. The first and second end portions 5*a* and 5*b* of the top surface of the intermediate member 5 are viewable and positioned to receive, hold, and support one or more objects or items. First and second top portions 2*a* and 2*b* of the base member are also exposed in the second orientation. These portions are not covered by either the intermediate member 5 or top member 3 in the second orientation so that a user may place an object on the top surface of the first and second top portions 2*a* and 2*b* of the base member 2.

The orientation to which the counter is placed may be made by rotating the top member independent and relative to the intermediate member 5 and base member 2. The intermediate member may also be rotated to a different degree independently of the top member and relative to the top member 3 and the base member 2. In some embodiments, at least one of the intermediate member 5 and top member 2 may also be moveable axially along at least a portion of the length L of the member to provide an even greater array of possible orientations. The direction along which the members are slideable or axially moveable may be a direction that is perpendicular or transverse to the axis A about which the member rotates (e.g. the slideability or moveability may be horizontally in a direction along which the length L of the member extends whereas the axis A extends vertically along a height H of the counter).

Moveable attachment of the intermediate member 5 to the base member 2 and moveable attachment of the top member 3 to the intermediate member 5 may be provided for in a number of ways. One embodiment of such moveable attachment mechanisms may be appreciated from FIGS. 3-9. For instance, a first moveable attachment mechanism 21 may attach a base support 12 of the base member 2 to an intermediate support 15 of the intermediate member 5.

It should be understood that the base support 12 may be a frame that has a number of different shapes or configurations to provide support to the intermediate member 5 and top member 3. For instance, the base support may be a cubical structure or rectangular structure that is aligned at a central location below the top and intermediate members 3 and 5. As another example, the base support 12 could alternatively be an elongated generally rectangular frame that is similar in construction or shape to intermediate support 15 and top support 13. A decorative housing or cover may be connected to the base support 12 to encase the base support 12 and provide a desired aesthetic effect or external appearance. The housing or decorative cover for the base support 12 may also be configured to permit attachment to shelves or drawers so that the drawers or shelves are supported by the base support 12 and are at least attached to the base support via a connection to the decorative cover or housing.

A second moveable attachment mechanism 22 may attach a top support 13 of the support member 3 to the intermediate support 15 of the intermediate member 5. In some embodiments, the base support 12, intermediate support 15 and top support 13 may each be a frame sized and configured to support other elements of the base member, intermediate member, and top member. For instance, these frames could support a housing, drawers and other elements that may be attached to the frames to provide a desired shape or aesthetic appearance to each member.

In some embodiments, the first and second moveable attachment mechanisms 21 and 22 may be similarly configured. In other embodiments, the first moveable attachment mechanism 21 may only provide rotational movement of the intermediate member 5 while the second moveable attachment mechanism 22 may permit the top member 3 to move in a horizontal direction about its length L (e.g. move axially in a direction along which its length L extends) as well as move rotationally.

For instance, the first moveable attachment mechanism 21 may include a rotatable cylindrical member that extends from the base support 12 to the intermediate support 15. A portion of the rotatable cylindrical member may extend from the base member 2 to the intermediate member 5. The cylindrical member may be rotatable for only a predetermined range, such as a range of 45°, 90°, or 180° or may be able to rotate throughout a full range (e.g. rotate along an entire 360° range). The rotational movement of the cylindrical member may, for example, be defined at least in part by a detent mechanism that is able to releasably lock a position of the rotatable member 32 to one or more different positions.

The detent mechanism may include a detent member that is releasably interlockable within a plurality of different recesses to define a path of rotational travel of the intermediate member. For instance, a detent may extend from a rotational member and be positionable within one of a plurality of openings defined within a plate that at least partially surrounds the rotatable cylindrical member. As another example, the rotatable member may have an opening and a plate that at least partially surrounds that member may have one or more lockable detents that are releasably interlockable within that opening. A spring may be attached to a detent member to provide the releaseable interlocking when the detent member is attached to a plate or the rotatable member. The openings may be positioned to define one or more positions about a degree of rotation (e.g. three spaced apart openings may be positioned along a 180 degree range of rotational travel to define different positions or seven openings may be spaced apart along a 360 degree range of rotational travel to define seven different selectable lockable positions) to define different positions to which the intermediate member may be positioned when rotated. Actuation of the detent member of the detent mechanism may occur via a force provided by a user or via actuation of an actuator such as a lever or button that is coupled to the detent member to move the detent member out of a locked position within an opening.

In some embodiments, a detent member may only be configured for releaseably locking the intermediate member 5 in a "home" position in which the intermediate member fully covers the base member and the intermediate and base members are perfectly aligned. The intermediate member 5 may subsequently be rotated to any of a number of positions and be maintained in those positions based on friction inducing mechanism configured to maintain the position of the intermediate member absent a force provided by a user to cause rotational movement of the intermediate member 5. The amount of friction that is induceable may be defined by plates or other structure that is positioned to engage or contact the rotatable cylindrical member when that member rotates or may be defined by the strength of the spring that acts on the detent member to cause the detent member to contact or drag along a surface surrounding the cylindrical member or the surface of the cylindrical member during rotation of the cylindrical member. Dampening mechanisms discussed more fully below may also be positioned to control the positioning of the intermediate member. The use of a frictional induction means to position the intermediate member 5 ensures that the member may be positioned in any position along a 360 degree of rotational travel of that member via the first moveable attachment mechanism 21.

A top portion of the rotatable cylindrical member may be attached to the intermediate support 15. For instance, the rotatable cylindrical member may be welded to the intermediate support 15 or may be interconnected via an interference fit between a hole defined in the intermediate support 15 and the top portion of the rotatable cylindrical member. In addition to the interference fit, one or more fasteners or an adhesive may also be applied to ensure the top portion of the cylindrical rotatable body is attached to the intermediate support 15. For example, in some embodiments, bolts or other fasteners may extend from a portion of the intermediate support and into the top portion of the cylindrical rotatable body to attach the intermediate support 15 to the first moveable attachment mechanism 21. A bracket or other fastener mechanism may also be utilized for attachment of the intermediate support 15 to the rotatable cylindrical body of the first moveable attachment mechanism 21.

The intermediate member 5 may be pushed or pulled by a user to rotate the intermediate member 5 via the first moveable attachment mechanism 21. For example, a user may pull or push one end of the intermediate member 5 to cause that member to rotate to a desired position. For some embodiments that may utilize a detent mechanism, a user may have to actuate the detent member via pressing a button, lever, or other actuator to move the detent member to an unlocked position prior to rotating the intermediate member. An infinite position lock or frictional lock mechanism may alternatively be utilized instead of the detent mechanism. For instance, when in a locked position one or more locking members may contact or otherwise engage a structure to maintain the position of the intermediate member until the locking member is moved to a release position or a force is provided by a user to overcome the locking force provided by the locking member.

The second moveable attachment mechanism 22 may have a rotatable member 32 that is attached or affixed to the intermediate support 15 and extends to the top support 13. The rotatable member 32 may be a cylindrical member for example that extends from the intermediate support 15 to the top support 13 and is affixed or attached to the top support. The rotatable member may be rotatable for only a predetermined range, such as a range of 45°, 90°, or 180° or may be able to rotate throughout a full range (e.g. rotate along an entire 360° range). The rotational movement of the cylindrical member may be defined at least in part by a detent mechanism that is able to releasably lock a position of the rotatable member 42 to one or more different positions. The detent mechanism may include a detent member that is releasably interlockable within a plurality of different recesses to define a path of rotational travel of the intermediate member. For instance, a detent may extend from a rotational member and be positionable within one of a plurality of openings defined within a plate that at least partially surrounds the rotatable cylindrical member. As another example, the rotatable member may have an opening and a plate that at least partially surrounds that member may have one or more lockable detents that are releasably interlockable within that opening. A spring may be attached to a detent member to provide the releasable interlocking when the detent member is attached to a plate or the rotatable member. The openings may be positioned to define one or more positions about a degree of rotation (e.g. three spaced apart openings may be positioned along a 180 degree range of rotational travel to define different positions or seven openings may be spaced apart along a 360 degree range of rotational travel to define seven different selectable lockable positions) to define different positions in which the top member may be rotated.

In some embodiments, a detent member may only be configured for releaseably locking the top member 3 in a "home" position in which the intermediate member fully covers the base member and the intermediate and base members are perfectly aligned. The top member 3 may subsequently be rotated to any of a number of positions and be maintained in those positions based on friction inducing mechanism configured to maintain the position of the top member absent a force provided by a user to cause rotational movement of the top member 3. The amount of friction that is induceable may be defined by plates or other structure that is positioned to engage or contact the rotatable cylindrical member when that member rotates or may be defined by the strength of the spring that acts on the detent member to cause the detent member to contact or drag along a surface surrounding the cylindrical member or the surface of the cylindrical member during rotation of the cylindrical member. Dampening mechanisms as referenced above and discussed more fully below may also be positioned to control the positioning of the top member. The use of a frictional induction means to position the top member 3 ensures that the member may be positioned in any position along a 360 degree of rotational travel of that member via the second moveable attachment mechanism 22.

A top portion of the rotatable cylindrical member may be attached to the top support 13 in a number of different ways. For instance, the rotatable cylindrical member may be welded to the top support 13 or may be interconnected via an interference fit between a hole defined in the top support 13 and the top portion of the rotatably cylindrical body. In addition to the interference fit, one or more fasteners or an adhesive may also be applied to ensure the top portion of the cylindrical rotatable body is attached to the top support 13. For example, in some embodiments, bolts or other fasteners may extend from a portion of the intermediate support and into the top portion of the cylindrical rotatable body to attach the top support 13 to the second moveable attachment mechanism 22. A bracket or other fastener mechanism may also be utilized for attachment of the top support 13 to the rotatable cylindrical body of the second moveable attachment mechanism 22. As yet another alternative, a slideability mechanism 31 may attach the rotatable member 32 to the top support 13.

The top member 3 may be pushed or pulled by a user to rotate the top member 3 via the second moveable attachment mechanism 22. For example, a user may pull or push one end of the top member 3 to cause that member to rotate to a desired position. For some embodiments that may utilize a detent mechanism, a user may have to actuate the detent member via pressing a button, lever, or other actuator to move the detent member to an unlocked position prior to rotating the intermediate member. In other embodiments, the locking of a position may be done with an infinite position locking device that is able to lock a position of the top member at any position within a path of travel defined for that member. For instance, when in a locked position one or more members may contact or otherwise engage a structure to maintain the position of the top member until the locking member is moved to a release position or a force is provided by a user to overcome the locking force provided by the locking member.

Figure 8:
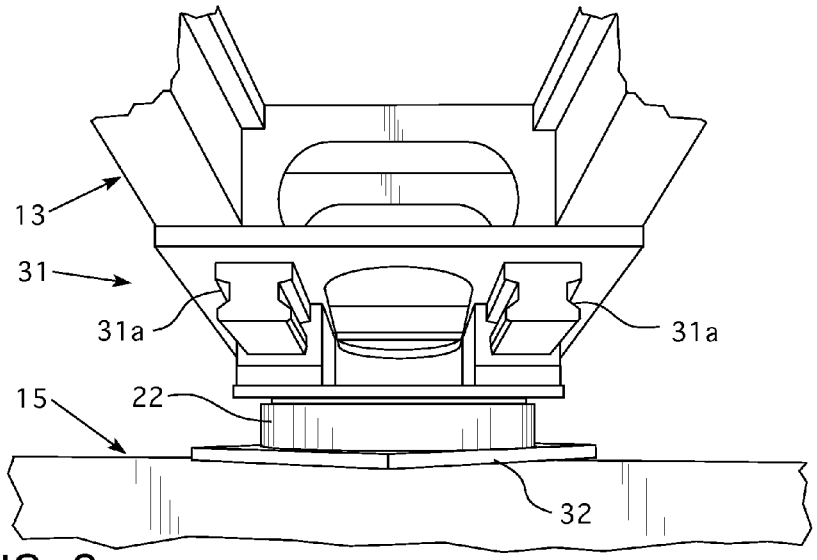
FIG. 8 is an enlarged fragmentary view of the first exemplary embodiment of the counter to illustrate the second moveable mechanism that attaches the intermediate member to the top member in a first position.
Figure 9:
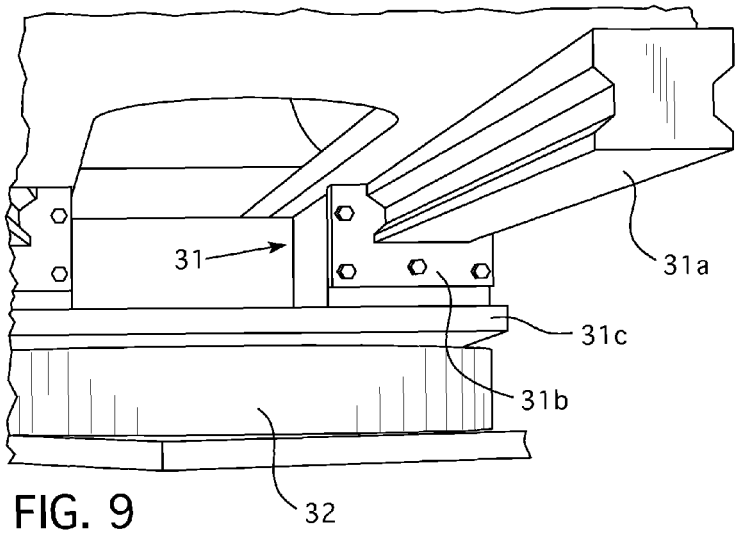
FIG. 9 is an enlarged fragmentary view of the first exemplary embodiment of the counter to illustrate a slideability mechanism of the second moveable mechanism in a second position.
Figure 10:
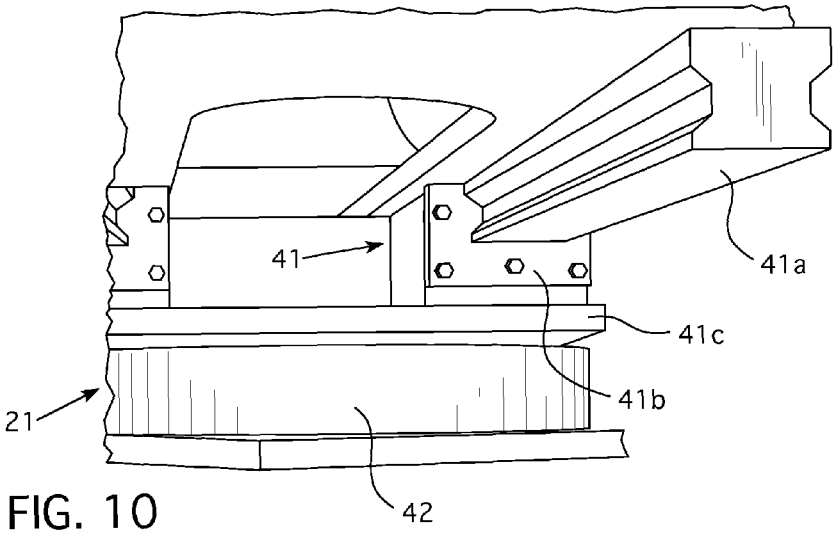
FIG. 10 is an enlarged fragmentary view of the first exemplary embodiment of the counter to illustrate a slideability mechanism of the first moveable mechanism in a second position.

In addition to the moveable attachment mechanisms, each of the top and intermediate supports 13 and 15 may include a slideable mechanism by which the member is slideable axially in a direction that is perpendicular or transverse to the rotational axis A about which that member rotates. Referring to FIGS. 8-9, a first slideability mechanism 31 is illustrated that may be attached to or incorporate in each of the top and intermediate supports 13 and 15. For instance, the first slideability mechanism 31 may attach the second moveable attachment mechanism 22 to the top support 13.

The first slideability mechanism 31 may include rails 31*a* that are attached to a portion of a frame of the top support 13. The rails 31*a* may be slideable within channels 31*b* defined within guides that are attached to a plate 31*c*. The plate 31*c* may be attached to the top of the rotatable member 32. The rails 31*a* may be slid along the channels 31*b* of the guides to axially move the top support 13 horizontally in a direction along which its length L extends, such as a predetermined distance that is 10% of the length L of the top member 3, 15% of the length L of the top member 3, 20% of the length L of the top member 3, 25% of the length L of the top member 3, or 50% of the length L of the top member 3. The rails 31*a* and guides having channels 31*b* may be positioned under the frame of the top support 13 so that the frame and entire decorative covering or housing of the top member 3 that may be attached to the frame is slideable axially.

A detent mechanism may be attached to the rails to releaseably lock within one or more openings defined adjacent the channel through which the rails slide. Alternatively, the detent mechanism could be attached to the guides defining the channels 31*b* and be lockable within one or more openings defined in the rails. The detent may releaseably lock the top member into any of a plurality of predefined positions along the path of linear travel defined by the rails and channels of the guides. Actuation of the detent mechanism may occur via an actuator connected to the detent mechanism. For instance, a button or lever may be coupled to a detent to cause that detent to move to cause the detent mechanism to unlock from an opening and permit sliding of the top member.

In addition to a detent mechanism, or as an alternative to a detent mechanism, the first slideability mechanism 31 may be configured so that friction induced by the sliding of the top member positions the top member or maintains the position of the top member after a user has stopped providing a force necessary to slide the top member 3. The size and shape of the rails and channels and the type of material selected for composition of the rails and channels may contribute to the induced friction. A first frictional level may be selected so that a first amount of force is needed to slide the top member. In some embodiments, that amount of force may be less than the amount of force needed to slide the intermediate member 5 to permit the top member 3 to slide independent of and relative to the intermediate member (e.g. the top member can then be slid without movement of the intermediate member being caused).

The decorative cover or housing may be attached to the slideable part of the frame of the top support 13 so that when the top member 3 is slid or otherwise moved axially along its length L the entire member is able to move horizontally or slide relative to the second moveable attachment mechanism 22, rotatable member 32, base member 2 and intermediate member 5. The decorative cover or housing may provide a top surface that can function as a countertop or other work surface on which objects can be supported. The housing or decorative cover may also be configured to permit attachment to shelves or drawers so that the drawers or shelves are supported by at least the top support 13 and base 2.

A second slideability mechanism 41 may also be attached to the intermediate support 15 so that the intermediate member may be slideable along a portion of its length L. The second slideability mechanism 41 may be structured similarly to the first slideability mechanism 31 discussed above and may attach the first moveable attachment mechanism 21 to the intermediate support 15 so that the intermediate support 15 is able to move axially in a horizontal direction in which its length L extends relative to the rotatable member 42 of the first moveable attachment mechanism 21. It should be appreciated that such a slideability mechanism 41 may have rails 41*a* that slide within guides 41*b* that are attached to a plate

41*c* that is affixed to the rotatable member 42 of the first moveable attachment mechanism 21. The rails 41*a* would be positioned under the intermediate support 15 so that the support could move horizontally in a direction that is perpendicular or transverse to the axis of rotation A about which the intermediate member 5 is rotatable via the rotatable member 42 of the first attachment mechanism 21.

A detent mechanism may be attached to the rails to releaseably lock within one or more openings defined adjacent the channel through which the rails 41*a* slide. Alternatively, the detent mechanism could be attached to the guides defining the channels within the guides 41*b* and be lockable within one or more openings defined in the rails. The detent may releaseably lock the top member into any of a plurality of predefined positions along the path of linear travel defined by the rails 41*a* and channels of the guides 41*b*. Actuation of the detent mechanism may occur via an actuator connected to the detent mechanism. For instance, a button or lever may be coupled to a detent to cause that detent to move to cause the detent mechanism to unlock from an opening and permit sliding of the top member.

In addition to a detent mechanism, or as an alternative to a detent mechanism, the second slideability mechanism 41 may be configured so that friction induced by the sliding of the intermediate member 5 positions the intermediate member or maintains the position of the intermediate member after a user has stopped providing a force necessary to slide the intermediate member 5. The size and shape of the rails and channels and the type of material selected for composition of the rails and channels may contribute to the induced friction. A predefined frictional level may be selected so that a second amount of force is needed to slide the intermediate member 5. In some embodiments, that amount of force may be greater than the amount of force needed to slide the top member 3 to permit the top member 3 to slide independent of and relative to the intermediate member (e.g. the top member can then be slid without movement of the intermediate member being caused). In other embodiments, the amount of force may be equal to or less than the amount of force needed to slide the top member so that movement of the top member also passively causes the intermediate member to slide.

A decorative cover or housing may be attached to the slideable part of the frame of the intermediate support 15 so that when the intermediate member 5 is slid or otherwise moved axially in a direction along which its length L extends the entire member is able to slide relative to the first moveable attachment mechanism 21, rotatable member 42, base member 2 and top member 3. The decorative cover or housing may provide a top surface that can function as a table top or other work surface on which objects can be supported. The housing or decorative cover may also be configured to permit attachment to shelves or drawers so that the drawers or shelves are supported by the intermediate support 15 and base 2.

Figure 11:
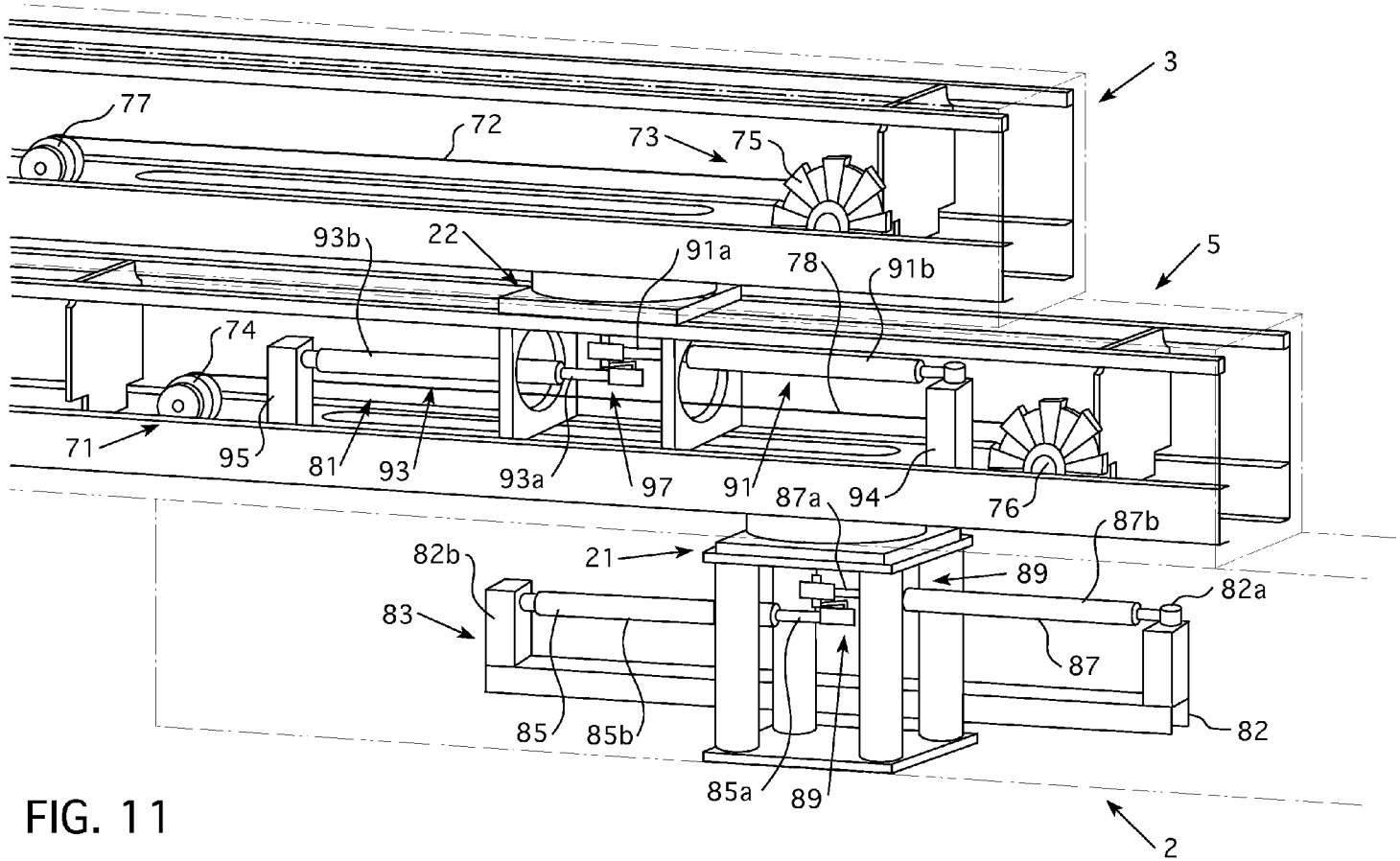
FIG. 11 is an enlarged view of the first exemplary embodiment illustrating a first exemplary embodiment of dampening mechanisms that may be utilized in the first exemplary embodiment of the counter.
Figure 12:
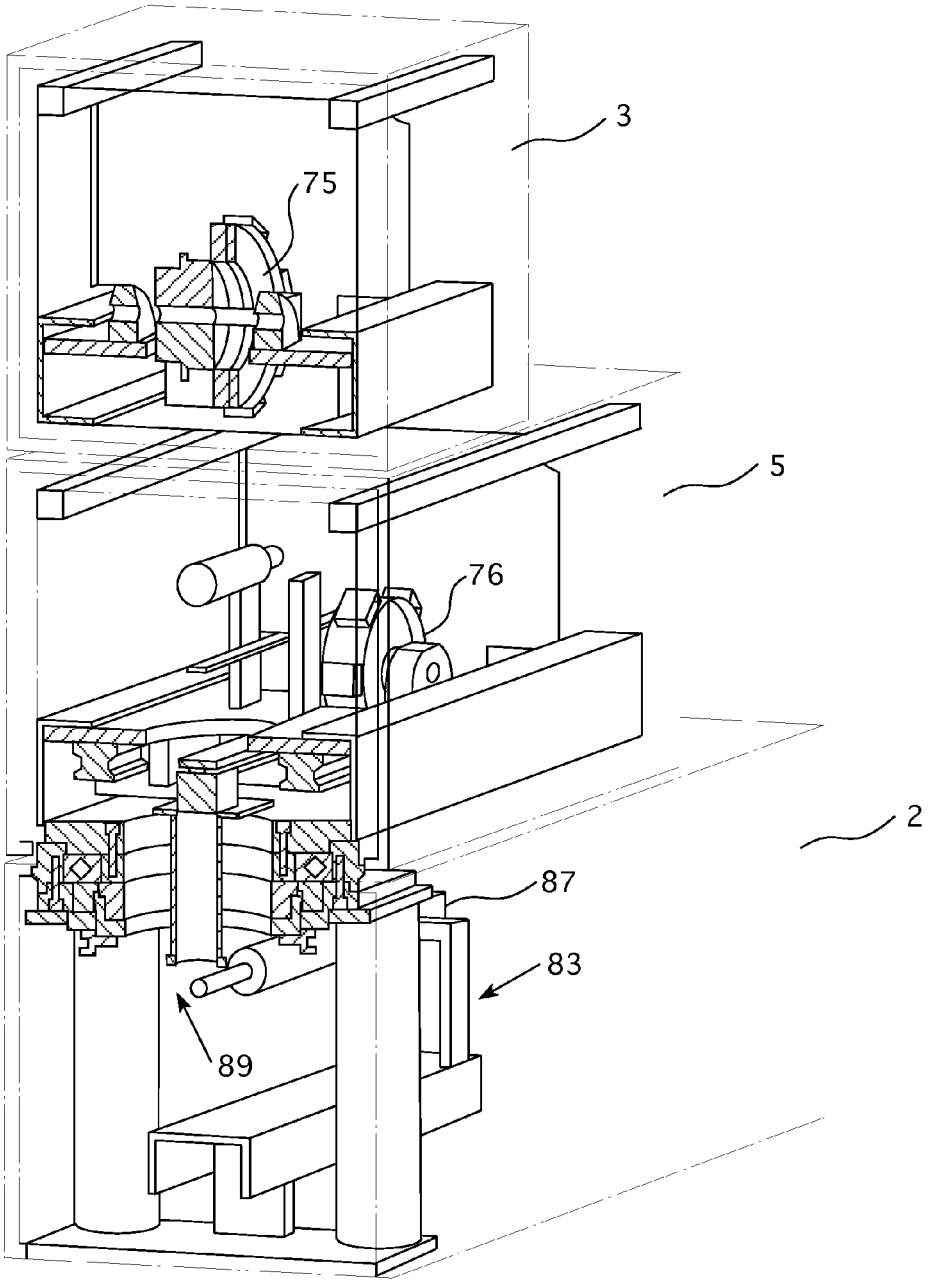
FIG. 12 is a cross-sectional view of the first exemplary embodiment shown in FIG. 11 taken along the height of the counter.
Figure 13:
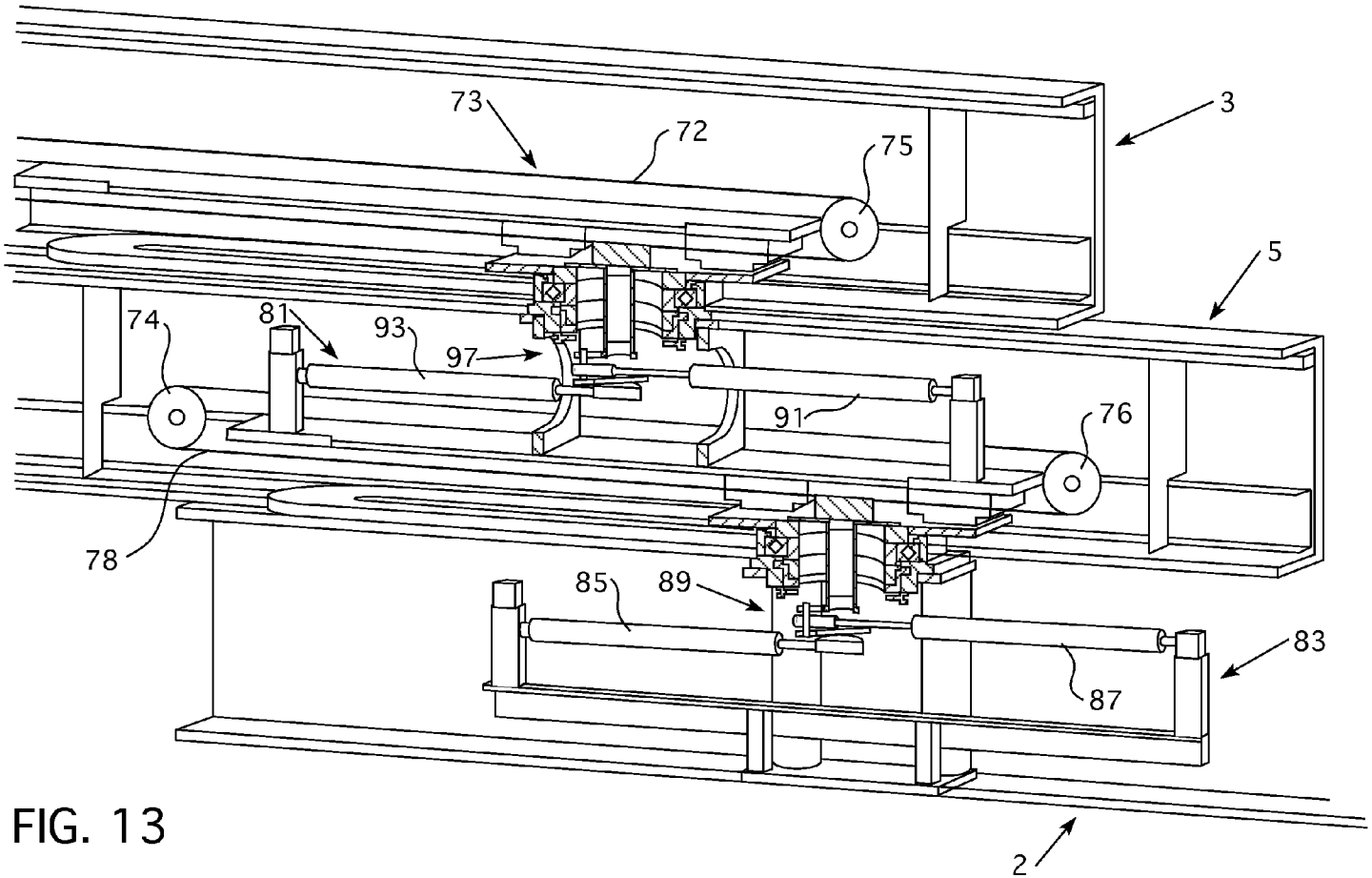
FIG. 13 is a longitudinal cross sectional view of the first exemplary embodiment shown in FIG. 11 taken along the length of the counter.

It should be appreciate that the article of furniture may also have multiple dampening mechanisms that help regulate the rate at which the intermediate and top members 5, 3 may be rotated and the rate at which the top and intermediate members 3, 5 may be slid. Examples of such dampening mechanisms may be appreciated from FIGS. 11-13.

In one embodiment, the first and second moveable attachment mechanisms 21, 22 and first and second slideability mechanisms 31, 41 may each be attached to at least one respective dampening mechanism. For instance, the first moveable attachment mechanism 21 may be coupled to a first rotatable dampening mechanism 83 and the second moveable attachment mechanism 22 may be coupled to a second rotatable dampening mechanism 81. The first slideability mechanism 31 of the top member 3 may be coupled to a first linear movement dampening mechanism 73 and the second slideability mechanism 41 of the intermediate member may be coupled to a second linear movement dampening mechanism 71.

The first rotatable dampening mechanism 83 may include a first dashpot 85 or other first damper element (e.g. linear damper, hydraulic damper, gas damper, rotary damper, etc.) and a second dashpot 87 or other second damper element (e.g. rotary damper, linear damper, hydraulic damper, gas damper, etc.) that is opposite the first dashpot 85. Each of the first and second dashpots 85, 87 of the first rotatable dampening mechanism 83 may have an extendable and retractable arm coupled to a respective gear or rotatable member that is coupled to a rotating member of the first moveable attachment mechanism 21. The receptacle member 85*b*, 87*b* of each of the first and second dashpots 85, 87 may be pivotally coupled to a support 82 at opposite ends 82*a* and 82*b* of the support 82. In some alternative embodiments, the support 82 may be replaced with posts that are positioned in opposite sides of the base member 2. A plurality of intermeshed gears or interconnected gear members 89 may be connected to the rotatable element of the moveable attachment mechanism to move away from the dashpot to which that gear is connected to extend that dashpot or retract that dashpot as the intermediate member is rotated. The force exerted by the dashpots can ensure that any rotation of the intermediate member occurs within a predefined rate that is defined by the forces exerted by the gasp springs.

For example, if a user rotates the intermediate member 5 via the first moveable attachment mechanism 21, the first dashpot 85 may have its moveable arm 85*a* extended while the second dashpot may have its moveable arm 87*a* retracted. The forces exerted by the first and second dashpots ensure that any rotational movement of the intermediate member 5 occurs smoothly and does not have an undesirable rate of change (e.g. it cannot be rotated too quickly, which could cause undesirable instability or a breakage of an element such as a plate or mirror that may be on the top of the article of furniture). As rotation of the intermediate member 5 proceeds to 180 degrees of rotation from its starting point, the first arm 85*a* may be fully extended or extended to its greatest extent from the first dashpot 85 and the second arm 87*a* may be fully retracted or retracted to its greatest extent. Beyond 180 degrees of rotation of the intermediate member from its starting point, the first moveable arm 85*a* may have been fully extended begin retracting and the second moveable arm may begin extending to continue to provide the desired dampening effect throughout an entire 360 degrees of rotation.

The size and force exerted by the first and second dashpots may be set to require a first level of force to be exerted on the intermediate member 5 to rotate that member. This first level of force may be greater than a level of force needed to rotate the top member 3 so that the top member 3 may be rotated independently of the intermediate member 5 or prevent a passive rotation of the intermediate member 5 that could be caused by force exerted to rotate the top member 3.

The second moveable attachment mechanism 22 may be coupled to the second rotatable dampening mechanism 81 similarly to the above discussed first rotatable dampening mechanism 83's coupling to the first moveable attachment mechanism 21. For instance, the second rotatable dampening mechanism 81 may include a first dashpot 91 and a second dashpot 93 that each have an extendable arm 91*a*, 93*a*, coupled to a rotatable member of the second moveable attachment mechanism 22 via a plurality of gears 97 or moveable elements and each have a receptacle member 91*b*, 93*b* that is pivotally coupled to a respective post 94, 95 or support that is positioned in the intermediate member 5. As an alternative to dashpots, hydraulic dampers, linear dampers, gas dampers, or other damper elements could be used.

Posts 94, 95 may be opposite each other and be located on opposite sides of the second moveable attachment mechanism 22, for example or be vertical members of a support that is positioned in the intermediate member 5 and be located on opposite ends of that support. The extendable and retractable arm 91*a*, 91*b* of each dashpot 91, 93 of the second rotatable dampening mechanism 81 may be coupled to a respective one of the gears 97 so that as the rotating element of the second moveable attachment mechanism 22 rotates during rotation of the top member 3 that extendable and retractable arms 91*a*, 93*a* move. For instance, the top member 3 may be rotated from a home position and the rotation of the top member may cause the extendable arm 91*a* of the first dashpot 91 to extend and also cause the extendable arm 93*a* of the second dashpot 93 to retract. As rotation of the top member reaches a position of 180 degrees of rotation from its starting point, the extendable arm 91*a* of the first dashpot may be at its fully extended position or be extended to a maximum amount and the retracting arm 93*a* of the second dashpot may be fully retracted or retracted to a maximum extent. As rotation proceeds from 180 degrees of rotation to 360 degrees of rotation the arm of the second dashpot 93 may extend and the arm of the first dashpot may retract.

The size and force exerted by the first and second dashpots 91, 93 of the second rotational dampening mechanism 81 may be preselected or otherwise designed to require a second level of force to be exerted on the top member 3 to rotate that member. This second level of force may be less than a level of force needed to rotate the intermediate member 5 so that the top member 3 may be rotated independently of the intermediate member 5 or prevent a passive rotation of the intermediate member 5 that could be caused by force exerted to rotate the top member 3. Alternatively, the second level of force may be equal to or greater than the first level of force needed to rotate the intermediate member so that rotation of the top member also causes rotation of the intermediate member 5 so that a passive rotation of the intermediate member may be actuated by rotation of the top member 3.

The top member 3 may also include a first linear movement dampening mechanism 73 or slide dampener that is coupled to the first slideability mechanism. The first linear movement dampening mechanism may include a first pulley 75 and a second pulley 77 located in opposite sides of the top member and a continuous chain or cable 72 that is entrained around the first and second pulleys and is configured to move along the pulleys as the top member is slid via the first slideability mechanism 31 so that the sliding movement is within a predetermine range of speeds or occurs at a predetermined rate of movement. Each of the first and second pulleys 75, 77 may be configured to rotate to drive movement of the chain or cable 73 at a first level of force so that slideability of the top member is only able to occur if a user applies a level of force that is at or over this first level of force. The first level of force may be set such that sliding of the top member 3 causes the intermediate member to also slide or may be set so that sliding of the top member 3 is able to occur relative to and independent of the intermediate member 5 (e.g. the top member 3 may slide linearly while the intermediate member 5 may not slide). The movement of the chain or cable 72 may be driven by one or both of the pulleys having a plurality of teeth that intermesh with a portion of the article of furniture to drive rotation of that pulley when the top member is moved. The tension of the cable or chain 73 that is looped around the pulleys may help define the amount of force needed to move the top member 3 or may help regulate how quickly the intermediate member may slide. One or more dashpots or rotary dampers may also act on one or both pulleys to set the level of force needed to move the pulley and regulate the speed at which the pulleys may be rotated in spite of the level of force provided that is over a predetermined amount. The linear movement dampening that is therefore provided may prevent unsafe quick movements of the top member 3 or instability of the article of furniture.

A second linear movement dampening mechanism 71 may be structured similarly to the first linear movement dampening mechanism 73 discussed above and be positioned in the intermediate member 5. For instance, the second linear movement dampening mechanism may include a first pulley 76 and second pulley 74 on opposite sides of the intermediate member and a continuous chain or cable 78 such as a chain loop or cable loop that is rotatable about these two pulleys. The pulleys may be configured so that a predetermined amount of force is needed to cause rotation of the cable or chain 78 that is within or above a second level of force. The second level of force may be set such that sliding of the intermediate member 5 causes the top member 3 to also slide. The movement of the cable or chain 78 may be driven by one or both of the pulleys having a plurality of teeth that intermesh with a portion of the article of furniture to drive rotation of that pulley when the intermediate member 5 is moved. The tension of the cable or chain 78 that is looped around the pulleys may help define the amount of force needed to move the intermediate member 5 or may help regulate how quickly the intermediate member may slide. One or more dashpots or rotary dampers may also act on one or both pulleys to set the level of force needed to move the pulley and regulate the speed at which the pulleys may be rotated in spite of the level of force provided that is over a predetermined amount. The linear movement dampening that is therefore provided may prevent unsafe quick movements of the intermediate member 5 or instability of the article of furniture.

It should be appreciated that different modifications to the counter 1 may be made to meet different design criteria. For instance, instead of one centrally located first and second moveable attachment mechanisms 21 and 22, there may be multiple spaced apart first moveable attachment mechanism 21 and second moveable attachment mechanism 22 that provide for moveable attachment. Each of such moveable attachment mechanisms may include sliding mechanisms as well. As another example, the size, configuration or shape of decorative coverings or housings may be any of a number of possible sizes and shapes. Similarly, the construction, size and shape of each of the base support 12, intermediate support 15 and top support 13 may be any of a number of options to meet a particular set of design criteria such as shape, cost, and appearance. As yet another example, in some embodiments the base support 12 may be configured to include multiple legs or a platform that engage a floor, such as the floor of a room in a building. As yet another alternative, a decorative covering or housing that encases the base support may have legs or other bottom that directly contacts a floor.

Therefore it should be understood that while certain present preferred counters and other types of articles of furniture and methods of making and using the same have been discussed and illustrated herein, it is to be distinctly understood that the invention is not limited thereto but may be otherwise variously embodied and practiced within the scope of the following claims.

What is claimed is:

1. An article of furniture comprising:

a base support;

an intermediate support moveably attached to the base support via a first moveable attachment mechanism;

a top support moveably attached to the intermediate support via a second moveable attachment mechanism;

a plurality of housings comprising a first housing, a second housing, and a third housing, the first housing attached to the top support to encase the top support and the second housing attached to the intermediate support to encase the intermediate support, the third housing being attached to the base support to encase the base support, the first housing being spaced from the second housing and the third housing being spaced apart from the second housing and the first moveable attachment mechanism comprising a first rotatable member, the first rotatable member rotating about a first axis of rotation such that the intermediate support is rotatable relative to the base support and is rotatable relative to the top support; and the second moveable attachment mechanism comprising a second rotatable member, the second rotatable member being rotatable about a second axis of rotation such that the top support is rotatable relative to the intermediate support and is also rotatable relative to the base support.

2. The article of furniture of claim 1 wherein the article of furniture is a counter.

3. The article of furniture of claim 2 wherein the second moveable attachment mechanism is also comprised of a slideability mechanism by which the top support is horizontally moveable relative to the intermediate support and the base support.

4. An article of furniture comprising:

a base support;

an intermediate support moveably attached to the base support via a first moveable attachment mechanism;

a top support moveably attached to the intermediate support via a second moveable attachment mechanism;

the first moveable attachment mechanism comprising a first rotatable member, the first rotatable member rotating about a first axis of rotation such that the intermediate support is rotatable relative to the base support and is rotatable relative to the top support; and the second moveable attachment mechanism comprising a second rotatable member, the second rotatable member being rotatable about a second axis of rotation such that the top support is rotatable relative to the intermediate support and is also rotatable relative to the base support, wherein the second moveable attachment mechanism is also comprised of a slideability mechanism by which the top support is horizontally moveable relative to the intermediate support and the base support;

wherein the article of furniture is a counter; and a plurality of housings comprising a first housing and a second housing, the first housing attached to the top support to encase the top support and a second housing attached to the intermediate support to encase the intermediate support.

5. The article of furniture of claim 4 wherein the slideability mechanism is attached between the second rotatable member and the top support.

6. The article of furniture of claim 4 wherein the slideability mechanism is comprised of a plate attached to a top portion of the second rotatable member, a plurality of guides attached to the plate, each of the guides having a channel, and a plurality of rails, each of the rails slideable within the channel of at least one of the guides, each of the rails attached to a frame of the top support.

7. The article of furniture of claim 4 wherein the slideability mechanism is a first slideability mechanism and the first moveable attachment mechanism is also comprised of a second slideability mechanism by which the intermediate support is horizontally moveable relative to the base support and the top support.

8. The article of furniture of claim 7 wherein the second slideability mechanism is comprised of a second plate attached to a top portion of the first rotatable member, a plurality of second guides attached to the second plate, each of the second guides having a second channel, and a plurality of second rails, each of the second rails slideable within the second channel of at least one of the second guides, each of the second rails is attached to a frame of the intermediate support.

9. The article of furniture of claim 4 wherein the housings also comprise a third housing, the third housing being attached to the base support to encase the base support.

10. The article of furniture of claim 9 wherein the first housing is spaced from the second housing and the third housing is spaced from the second housing and wherein a portion of the second rotatable member extends out of the second housing and into the first housing and a portion of the first rotatable member extends out of the third housing and into the second housing.

11. The article of furniture of claim 4 wherein the first rotatable member is generally cylindrical in shape and the second rotatable member is generally cylindrical in shape.

12. A counter comprising:

a base support;

an intermediate support moveably attached to the base support via a first moveable attachment mechanism;

a top support moveably attached to the intermediate support via a second moveable attachment mechanism;

a plurality of housings comprising a first housing, a second housing, and a third housing, the first housing attached to the top support to encase the top support and the second housing attached to the intermediate support to encase the intermediate support, the third housing being attached to the base support to encase the base support, the first housing being spaced from the second housing and the third housing being spaced apart from the second housing and the first moveable attachment mechanism comprising:

a first rotatable member, the first rotatable member rotating about a first axis of rotation such that the intermediate support is rotatable relative to the base support and is rotatable relative to the top support; and the second moveable attachment mechanism comprising:

a second rotatable member, a top portion of the second rotatable member attached to the top support, the second rotatable member being rotatable about a second axis of rotation such that the top support is rotatable relative to the intermediate support and is also rotatable relative to the base support, and a first slideability mechanism attached to a top portion of the second rotatable member to attach the second rotatable member to the top support, the first slideability mechanism moveably attaching the top support to the second rotatable member such that the top support is horizontally moveable relative to the intermediate support and the base support.

13. The counter of claim 12 wherein the first slideability mechanism is comprised of a first plate attached to a top portion of the second rotatable member, a plurality of first guides attached to the first plate, each of the first guides having a first channel, and a plurality of first rails, each of the first rails slideable within the channel of at least one of the first guides, each of the first rails e attached to a frame of the top support.

14. The counter of claim 13 wherein the first moveable attachment mechanism is also comprised of a second slideability mechanism by which the intermediate support is horizontally moveable relative to the base support and the top support.

15. The counter of claim 14 wherein the second slideability mechanism is comprised of a second plate attached to a top portion of the first rotatable member, a plurality of second guides attached to the second plate, each of the second guides having a second channel, and a plurality of second rails, each of the second rails slideable within the second channel of at least one of the second guides, each of the second rails is attached to a frame of the intermediate support.

16. A counter comprising:

a base support;

an intermediate support moveably attached to the base support via a first moveable attachment mechanism;

a top support moveably attached to the intermediate support via a second moveable attachment mechanism;

the first moveable attachment mechanism comprising:

a first rotatable member, the first rotatable member rotating about a first axis of rotation such that the intermediate support is rotatable relative to the base support and is rotatable relative to the top support; and the second moveable attachment mechanism comprising:

a second rotatable member, a top portion of the second rotatable member attached to the top support, the second rotatable member being rotatable about a second axis of rotation such that the top support is rotatable relative to the intermediate support and is also rotatable relative to the base support, and a first slideability mechanism attached to a top portion of the second rotatable member to attach the second rotatable member to the top support, the first slideability mechanism moveably attaching the top support to the second rotatable member such that the top support is horizontally moveable relative to the intermediate support and the base support;

wherein the first slideability mechanism is comprised of a first plate attached to a top portion of the second rotatable member, a plurality of first guides attached to the first plate, each of the first guides having a first channel, and a plurality of first rails, each of the first rails slideable within the channel of at least one of the first guides, each of the first rails attached to a frame of the top support; and wherein the first moveable attachment mechanism is also comprised of a second slideability mechanism by which the intermediate support is horizontally moveable relative to the base support and the top support;

a first linear movement dampening mechanism attached to the first slideability mechanism;

the first linear movement dampening mechanism comprising a first pulley and a second pulley positioned adjacent opposite ends of the top support and a chain or cable entrained around the first and second pulleys of the first linear movement dampening mechanism, at least one of the first and second pulleys of the first linear movement dampening mechanism connected to the top support such that horizontal linear motion of the top support drives rotation of the chain or cable around the first and second pulleys of the first linear movement dampening mechanism.

17. The counter of claim 16 comprising:

a first rotatable dampening mechanism connected to the first rotatable member; and a second rotatable dampening mechanism connected to the second rotatable member.

18. The counter of claim 17 comprising:

a second linear movement dampening mechanism connected to the second slideability mechanism, the second linear movement dampening mechanism comprising a first pulley and a second pulley positioned adjacent opposite ends of the intermediate support and a chain or cable entrained around the first and second pulleys of the second linear movement dampening mechanism, at least one of the first and second pulleys of the second linear movement dampening mechanism connected to the intermediate support such that linear horizontal motion of the intermediate support drives rotation of the chain or cable around the first and second pulleys of the second linear movement dampening mechanism.

19. The counter of claim 18 wherein the first rotatable dampening mechanism comprises at least one damper element connected to the first rotatable member by at least one gear member to regulate a speed at which the first rotatable member is rotatable; and the second rotatable dampening mechanism comprises at least one damper element connected to the second rotatable member by at least one gear member to regulate a speed at which the second rotatable member is rotatable.

20. A counter comprising:

a base support;

an intermediate support moveably attached to the base support via a first moveable attachment mechanism;

a top support moveably attached to the intermediate support via a second moveable attachment mechanism;

the first moveable attachment mechanism comprising:

a first rotatable member, the first rotatable member rotating about a first axis of rotation such that the intermediate support is rotatable relative to the base support and is rotatable relative to the top support; and the second moveable attachment mechanism comprising:

a second rotatable member, a top portion of the second rotatable member attached to the top support, the second rotatable member being rotatable about a second axis of rotation such that the top support is rotatable relative to the intermediate support and is also rotatable relative to the base support, and a first slideability mechanism attached to a top portion of the second rotatable member to attach the second rotatable member to the top support, the first slideability mechanism moveably attaching the top support to the second rotatable member such that the top support is horizontally moveable relative to the intermediate support and the base support, wherein the first slideability mechanism is comprised of a first plate attached to a top portion of the second rotatable member, a plurality of first guides attached to the first plate, each of the first guides having a first channel, and a plurality of first rails, each of the first rails slideable within the channel of at least one of the first guides, each of the first rails attached to a frame of the top support; and a plurality of housings comprising a first housing, a second housing, and a third housing, the first housing attached to the top support to encase the top support and the second housing attached to the intermediate support to encase the intermediate support, the third housing being attached to the base support to encase the base support; and the first housing being spaced from the second housing and the third housing being spaced apart from the second housing and wherein a portion of the second rotatable member extends out of the second housing and into the first housing and a portion of the first rotatable member extends out of the third housing and into the second housing.

* * * * *